United States Patent [19]

Rinholen

[11] Patent Number: 4,835,981

[45] Date of Patent: Jun. 6, 1989

[54] AIR CONDITIONER WITH IMPROVED THERMOSTATING OPERATION

[75] Inventor: Robert K. Rinholen, Blairstown, Iowa

[73] Assignee: Amana Refrigeration, Inc., Amana, Iowa

[21] Appl. No.: 175,983

[22] Filed: Mar. 31, 1988

[51] Int. Cl.[4] ..... F25B 1/00

[52] U.S. Cl. ..... 62/229; 62/262; 236/DIG. 19

[58] Field of Search ..... 62/229, 180, 186, 262; 236/DIG. 19

[56] References Cited

U.S. PATENT DOCUMENTS 3,293,875 12/1966 Kelly ..... 62/229 X 3,411,311 11/1968 Wegman ..... 62/229 X 4,524,588 6/1985 Bond ..... 62/262

*Primary Examiner*—William E. Wayner

*Attorney, Agent, or Firm*—William R. Clark; Richard M. Sharkansky

[57] ABSTRACT

An air conditioner having a thermal insulation cover forming a pocket around the thermostat bulb which is mounted to the outside wall of the air intake chamber. The cover has an aperture and the outside wall has a plurality of holes communicating with the pocket whereby, when the blower is activated, a flow of ambient room air is drawn through the pocket so that the bulb accurately reflects the temperature of the room being cooled. The cover thermally isolated the thermostat bulb from hot outside fresh air so that the thermostat bulb is not falsely biased.

7 Claims, 5 Drawing Sheets

AIR CONDITIONER WITH IMPROVED THERMOSTATING OPERATION

BACKGROUND OF THE INVENTION

The field of the invention generally relates to air conditioning, and more particularly relates to apparatus for accurately thermostating the operation of an air conditioner.

As is well known, it is common to provide a main partition in an air conditioner with the evaporator being on the room side of the partition, and the condenser and compressor being on the outside. In a typical prior art configuration, an evaporator blower is positioned to one side of the evaporator, and an air intake chamber is located in front of the evaporator blower. In operation, the evaporator blower draws air from the room in through the air intake chamber, and recirculates it through the evaporator back to the room.

It is also common to provide air conditioners with a thermostat control. More specifically, when a temperature sensor gets down to a particular temperature as determined by the thermostat setting, the control turns off the evaporator blower, condenser fan, and compressor. Then, after the temperature of the sensor rises a predetermined amount, the control turns the evaporator blower, condenser fan, and compressor back on for another thermostating cycle. The desired result of these thermostating cycles is, of course, to maintain the room at a fairly constant predetermined temperature. Conventionally, a thermostat bulb has been used to sense the temperature, and it is connected by a capillary tube to a pressure sensitive switch which is mounted on the control panel. In a standard prior art configuration, the thermostat bulb is positioned in the air intake chamber.

It is also well known that it is desirable to be able to introduce fresh air from the outside to mix with the recirculating room air. In fact, for certain specified applications such as, for example, nursing homes, federal regulations require that fresh air constitute at least 20% of the rated evaporator air. Generally, fresh air is introduced through a vent in the partition between the room side and the outside. The vent is provided with a door. When the door is closed, only room air is circulated. However, when the door is open and the fan is activated, fresh air is drawn through the vent in the partition and it mixes with recirculating room air before being directed through the evaporator.

It has been found that with the above-described air conditioner arrangement, there can be a tendency for the air conditioner to short cycle. That is, the air conditioner may cycle back on before there is a sufficient delay, and such operation may cause a relatively high compressor failure rate. Also, it has been found that the room temperature has not been closely controlled or regulated.

SUMMARY OF THE INVENTION

It is an object of the invention to provide improved thermostating apparatus for an air conditioner.

It is another object to provide an air conditioner that does not have short cycles. It is a further object that the room temperature be held relatively constant at a predetermined thermostat setting.

It is also an object to provide an air conditioner that has a thermostat sensor that is sufficiently isolated from outside fresh air so that it is not falsely biased. Further, it is an object to position the thermostat sensor in the flow path of the intake room air so that it will provide a normalized or nonlocalized indication of the air temperature in the room.

The above and other objects are provided by the invention which defines an air conditioner comprising a partition separating outside fresh air from room air, an evaporator positioned on the room air side of the partition, a blower for recirculating room air through the evaporator, the blower having an inlet drawing air and an outlet coupled to the evaporator, means for introducing outside fresh air into the recirculating room air, the introducing means comprising a vent in the partition and a door for closing the vent when outside fresh air is not desired, the vent communicating with the inlet of the blower, a temperature sensor for sensing the temperature of room air, means responsive to the temperature sensor for cycling the air conditioner on and off, and a thermally insulated pocket for housing the temperature sensor, the pocket comprising means for providing a flow of recirculating room air over the temperature sensor. With such arrangement, the temperature sensor is not significantly exposed to fresh air that flows in through the vent. Rather, the temperature of the temperature sensor is substantially determined by the room air flowing through the pocket. As a result, it has been found that the room temperature is closely controlled to the thermostat set temperature. Also, short cycling is prevented thus increasing the life of the compressor.

BRIEF DESCRIPTION OF THE DRAWINGS

The foregoing objects and advantages will be more fully understood by reading the Description of the Preferred Embodiment with reference to the drawings wherein.

DESCRIPTION OF THE PREFERRED EMBODIMENT

Figure 1:
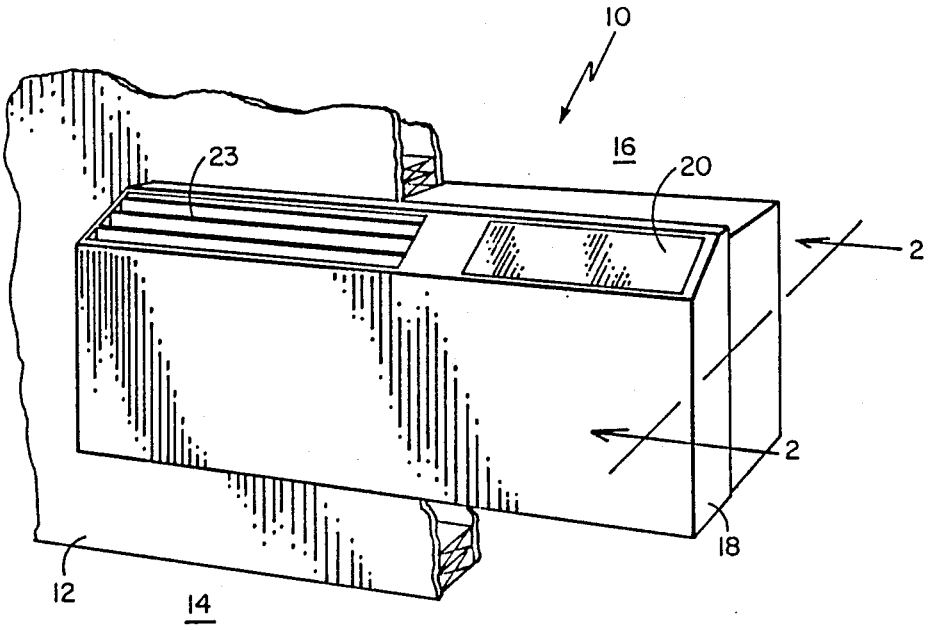
FIG. 1 is a front perspective view of an air conditioner.

In accordance with the invention, the thermostat bulb 104 is mounted adjacently and spaced from the outward side wall 114 of the air intake chamber 46 of the evaporator blower 36, and the bulb 104 is encased by a thermally insulating cover 116 or capsule that forms a pocket 122 around the bulb 104. With such cover 116, there is substantial thermal isolation between the bulb 104 and fresh air flowing in through the vent 34. Accordingly, false temperature bias caused by not fresh air flowing against the bulb 104 is substantially eliminated. Also, cover 116 is provided with an aperture 142 and side wall 114 has several holes 144 so that when blower 36 is operating, ambient room air is drawn via holes 144 from channel 146 through pocket 122 and aperture 142 into chamber 46. Thus, the bulb 104 accurately senses the temperature of room air.

Figure 2:
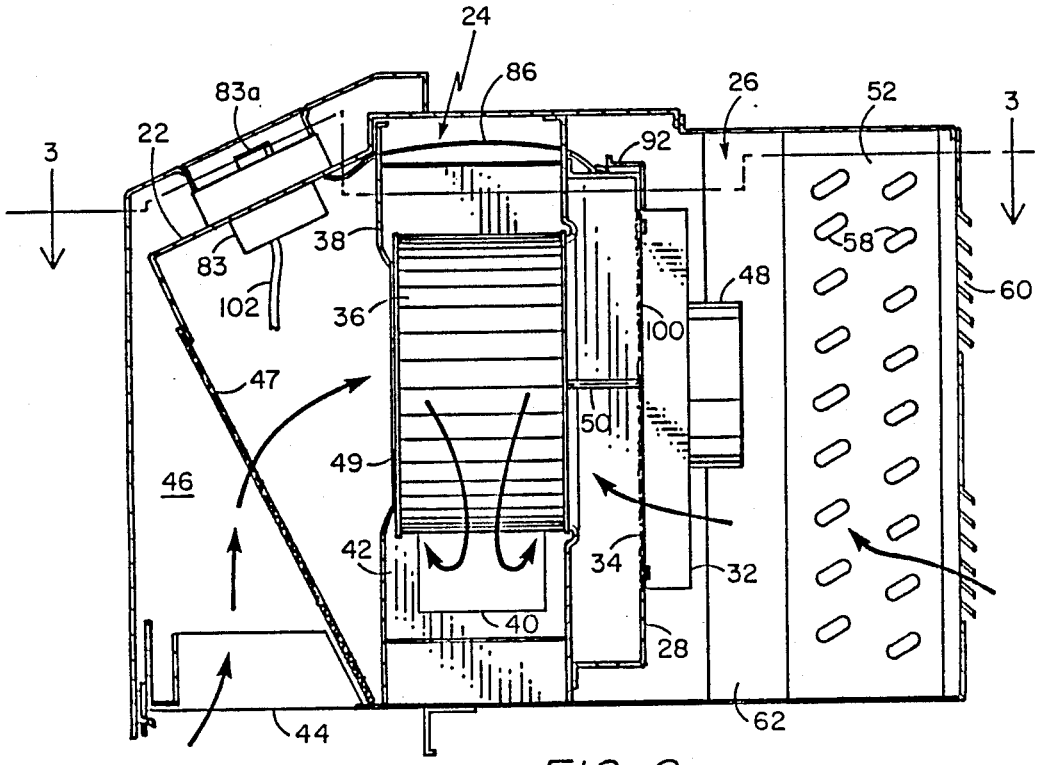
FIG. 2 is a view taken along line 2—2 of the air conditioner of FIG. 1.

Now, referring specifically to FIG. 1, an air conditioner 10 is shown mounted in wall 12. On the inside is the room 14 to be cooled, and on the outside 16 is fresh air. Although air conditioner 10 is here shown as a wall mounted unit, it is understood that the inventive principle would have application to other types of air conditioners such as window or floor mounted units. The room side of air conditioner 10 is enclosed by an outer casing 18 which has a lid 20 which can be lifted in order to gain access to control panel 22 (FIG. 2). Also, a grill 23 is provided for recirculating air back into the room 14.

Figure 3:
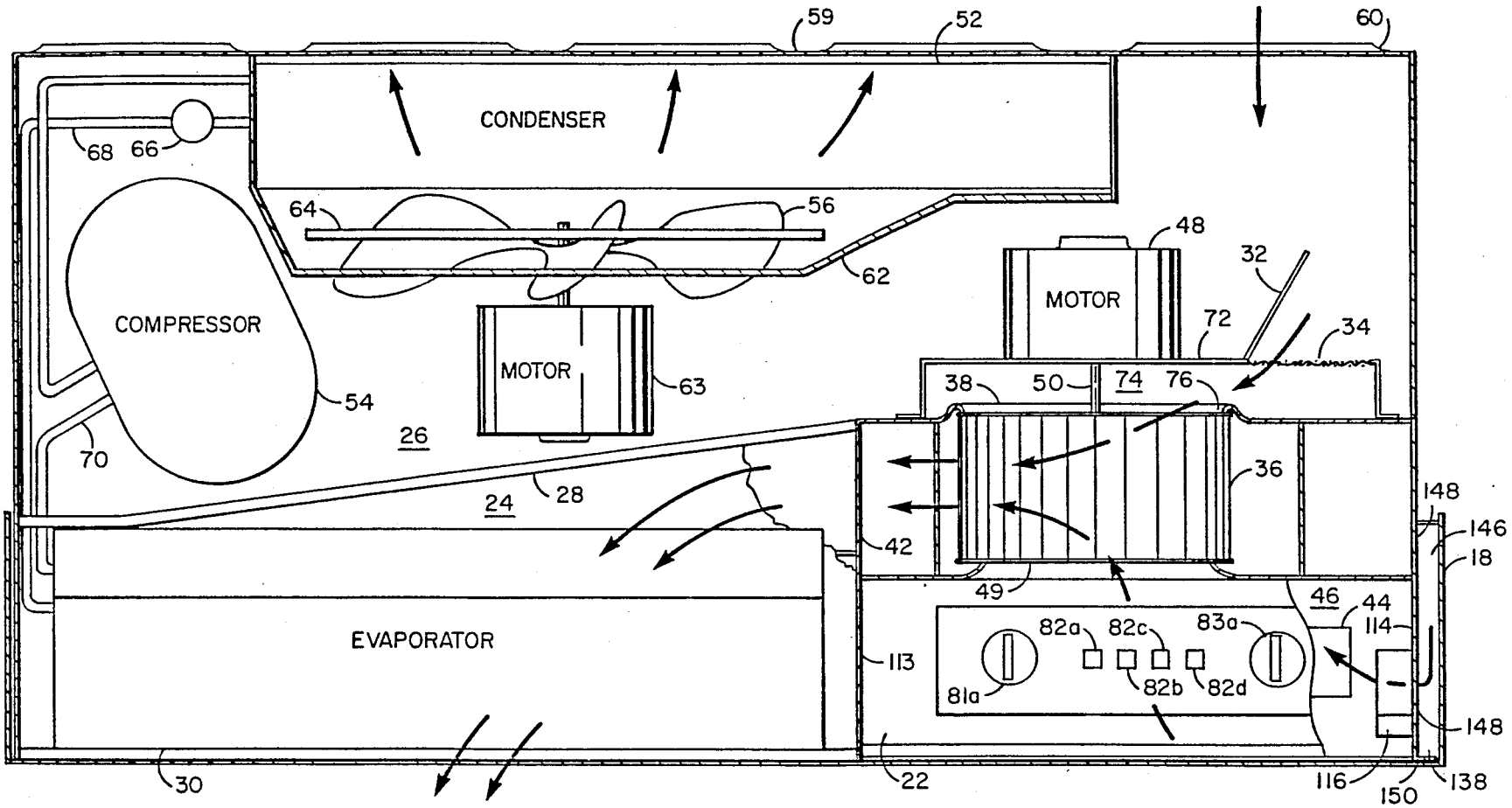
FIG. 3 is a view taken along line 3—3 of FIG. 2.

Referring to FIGS. 2 and 3, there are shown respective views of air conditioner 10 taken along lines 2—2 of FIG. 1 and 3—3 of FIG. 2. As is conventional, air conditioner 10 is generally divided into a front compartment 24 and back compartment 26 by a main partition 28 which runs laterally and sometimes is referred to as the main bulkhead or partition panel. Partition 28 functions as a barrier to prevent noise and outside air from entering the room 14 to be cooled. In one mode of operation, all outside fresh air is prevented from flowing from the back compartment 26 to the front compartment 24 such that all of the air being cooled by conventional evaporator 30 is recirculation air from the room; this operation occurs when door 32 is closed such that fresh air is prevented from flowing through vent 34 in partition 28. The evaporator blower wheel 36 within blower wheel scroll 38 in activated and it directs air through scroll discharge opening 40 which communicates through baffle 42 to evaporator 30. As shown best in FIG. 2, the draft created by evaporator blower wheel 36 draws recirculation air from room 14 in through intake port 44 to air intake chamber 46 which has inward and outward side walls 113 and 114, and is divided by air filter 47. From air intake chamber 46, the air enters evaporator blower wheel 36 via recirculation air orifice 49 or inlet at the front side of wheel 36. Evaporator blower wheel 36 is driven by evaporator blower motor 48 which is connected by suitable means to the back compartment 26 side of main partition 28. A shaft 50 extends from motor 48 to the evaporator blower wheel 36.

Air from evaporator blower wheel 36, which passes through scroll discharge opening 40, enters the under side of conventional evaporator 30. After it flows upwardly through evaporator 30, it exits air conditioner 10 into the room 14 through grill 23. As is well known, there is heat transfer from the air to the cool tubes and fins (not shown) of evaporator 30. The heat exchange transfer between the evaporator 30 and condenser 52 is also conventional. More specifically, a working fluid commonly referred to as a refrigerant goes through a thermodynamic cycle. The refrigerant leaves compressor 54 as a vapor at an elevated pressure and then condenses in the condenser 52 resulting in the transfer of heat to the condenser 52. This heat is removed by using condenser fan 56 to pass air across the tubes 58 and fins (not shown) of condenser 52 for exit to the outside through rear louvered wall 59 of the outward or back compartment 26. The side 60 of louvered wall 59 also communicates with the outside, and fresh air is drawn into the condenser fan shroud 62 by the condenser fan 56. Condenser fan motor 63 provides the drive for condenser fan 56. Condenser fan 56 may preferably have a conventional slinger ring 64 which is used for blowing condensed water out through condenser 52.

The high pressure refrigerant liquid passes from the condenser 52 through an expansion valve 66 or capillary tube where some of the refrigerant liquid flashes into vapor. The remaining fluid passes through conduit 68 to the evaporator 30 where it vaporizes as a result of the relatively low pressure in evaporator 30. The heat to support the vaporization is transferred from the recirculating air that is directed through evaporator 30 by evaporator blower wheel 36. The closed loop is completed by conduit 70 that connects the relatively low pressure evaporator 30 to compressor 54. Both conduits 68 and 70 pass through small openings in partition 28. Those skilled in the art will recognize that air conditioner 10 as described can be made to function as a room heater by providing additional components (not shown) that reverse the direction of flow of the refrigerant so that the functions of condenser 52 and evaporator 30 are reversed. Accordingly, warm air would be blown into the room and cool air would be exhausted to the outside. Further, air conditioner 10 could operate as a heater by positioning electric resistive coils (not shown) adjacent to evaporator 30, and then activating evaporator blower wheel 36 while the coils are energized and the compressor 54 is deactivated.

Fresh air box 72 is connected behind the evaporator blower wheel 36 and functions as part of main partition 28 for that portion of the air conditioner 10 that it encloses. Fresh air box 72 defines a fresh air vent chamber 74 which spaces evaporator blower wheel 36 from the fresh air box 72, or from partition 28 as the box may be viewed. As described earlier herein, when door 32 closes off vent 34, all the air directed to evaporator 30 is recirculation air from the room 14 being cooled because the fresh air in back compartment 26 is sealed off. When vent door 32 is open, however, fresh air from back or outward compartment 26 is positively drawn by evaporator blower wheel 36 through fresh air vent 34 into fresh air chamber 74 defined by fresh air box 72. Evaporator blower wheel 30 has a fresh air orifice 76 or blower inlet on the back side facing fresh air chamber 74. The fresh air from fresh air chamber 74 is thus drawn into evaporator blower wheel 36 through fresh air orifice 76 which is on the opposite side of blower 30 from which recirculation air enters. The fresh air and recirculation air mix for the first time within evaporator blower wheel 36, and are directed through scroll discharge opening 40 to evaporator 30.

Figure 4:
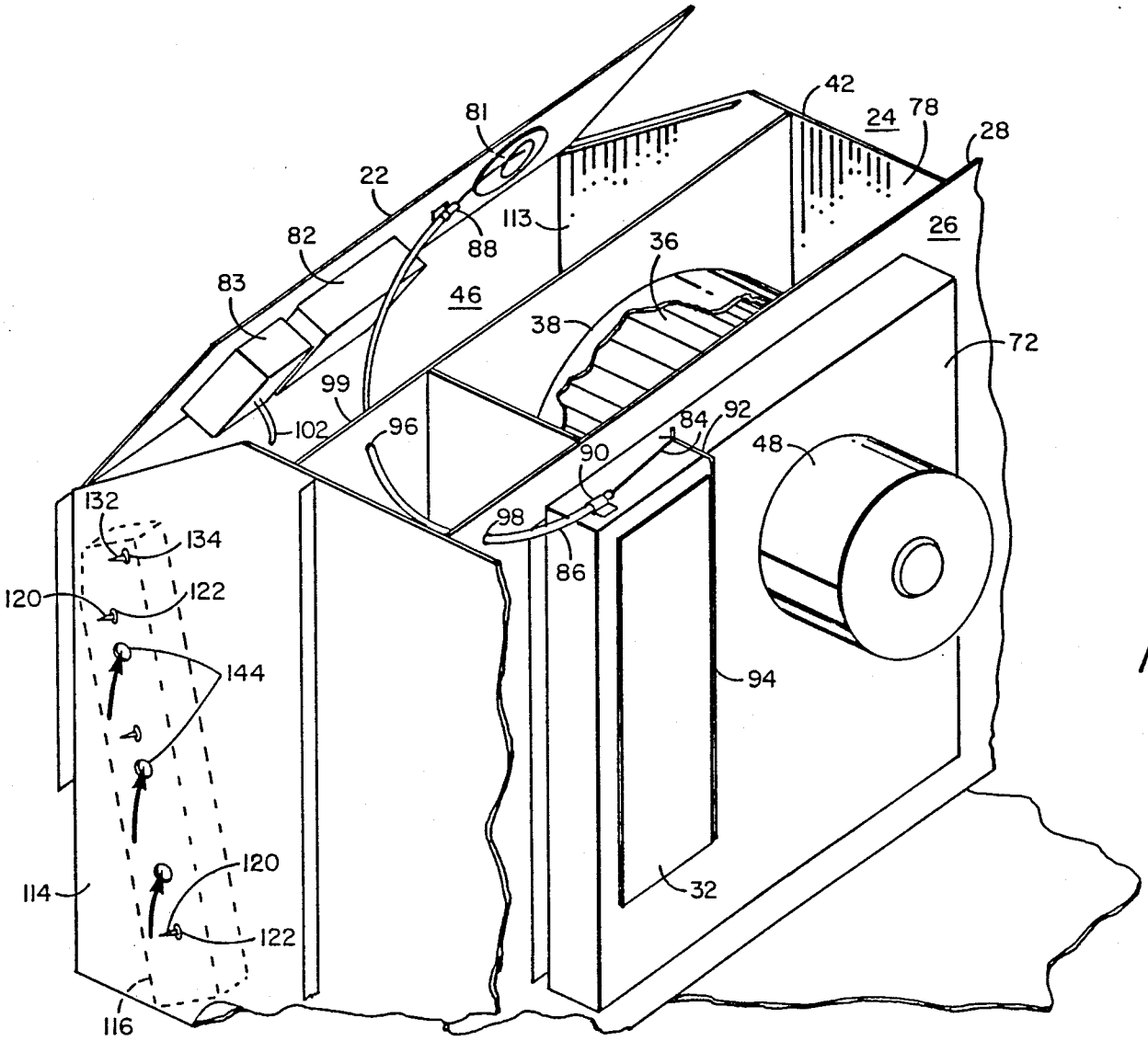
FIG. 4 is a partially broken-away rear perspective view of the evaporator blower section of the air conditioner without the other casing.
Figure 5:
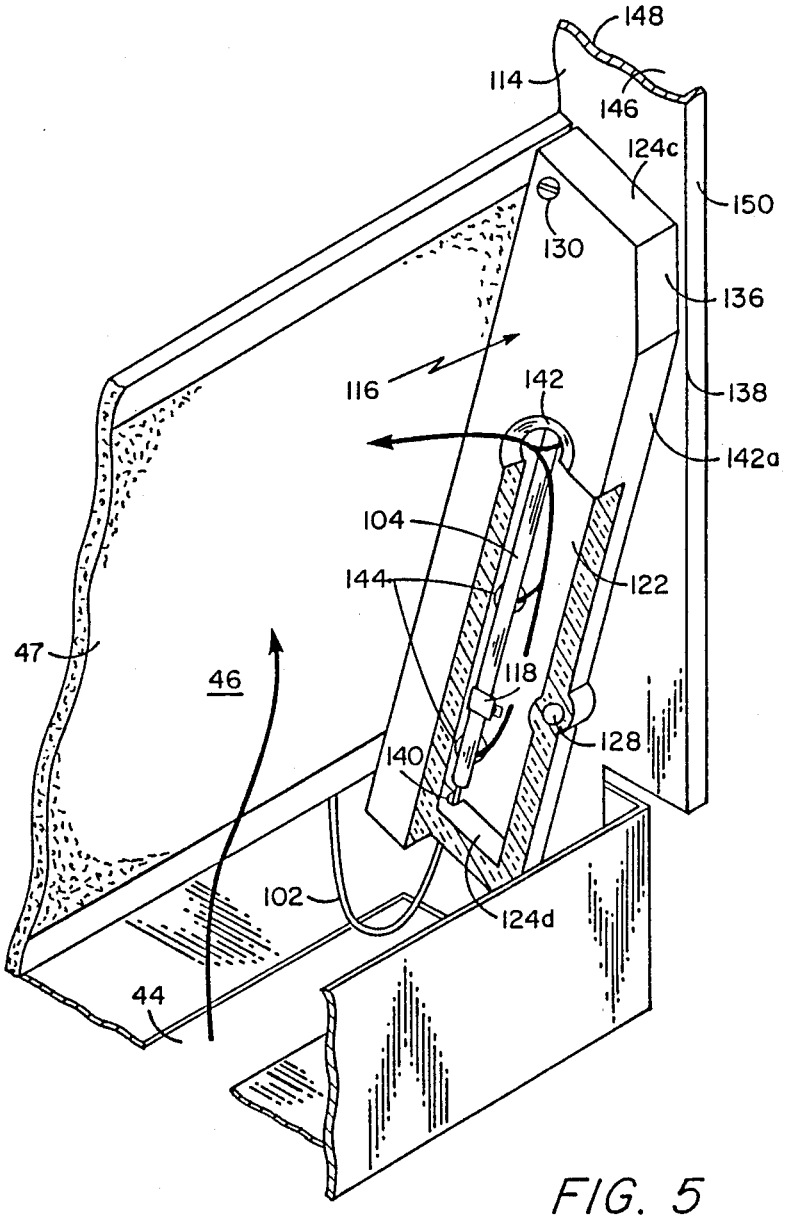
FIG. 5 is a front perspective view of the air intake chamber showing a sectioned view of the cover encasing the thermostat bulb.

Referring to FIG. 4, a partially broken-away rear perspective view of the evaporator blower section 78 of air conditioner 10 is shown. Control panel 22 is depicted in a tilted forward position for illustration, and the controls 81–83 are shown diagrammatically because they are conventional. A cable 84 with sheath 86 connects at points 88 and 90 and is used to open and close door 32 in a conventional manner. More specifically, an arm 92 extending from hinge 94 is pushed or pulled laterally by cable 84 in response to operator rotation of control knob 81*a*. Cable 84 with sheath 86 is shown routed through respective holes 96 and 98 in panel 99 and partition 28. A metal screen 100 (FIG. 2) in vent 34 functions to keep animals from entering from the outside. Control knobs 82*a–d* may conventionally control the speed of the evaporator blower wheel 36 and activate the cooling or heating modes. Control knob 83*a* is used to manually set the thermostat temperature of thermostat control 83. For example, control knob 83*a* may be set to a plurality of graduations from a high to a low temperature. Here, thermostat control 83 is a pressure sensitive switch which conventionally responds to the pressure applied by capillary tube 102 from thermostat bulb 104 (FIG. 5). Those skilled in the art will recognize that the invention can be used to advantage with other types of thermostat controls and sensors, such as, for example, bimetallic thermostats.

Referring to FIG. 5, a conventional thermostat bulb is shown with a capillary tube 102, which, as described earlier, leads to pressure sensitive thermostat control 83. In accordance with the invention, thermostat bulb 104 is mounted in a position parallel and spaced from outward side wall 114 of air intake chamber 46, and thermostat bulb 104 is shielded by a thermally insulating cover 116 or capsule. Here, bulb 104 is mounted adjacent to outward wall 114 using wrap-around plastic brackets 118 that have snap ends 120 that insert through mounting holes 122 in outward wall 114. Preferably, plastic brackets 118 are made of a material that resists thermal conduction from outward wall 114 to thermostat bulb 104.

Figure 6:
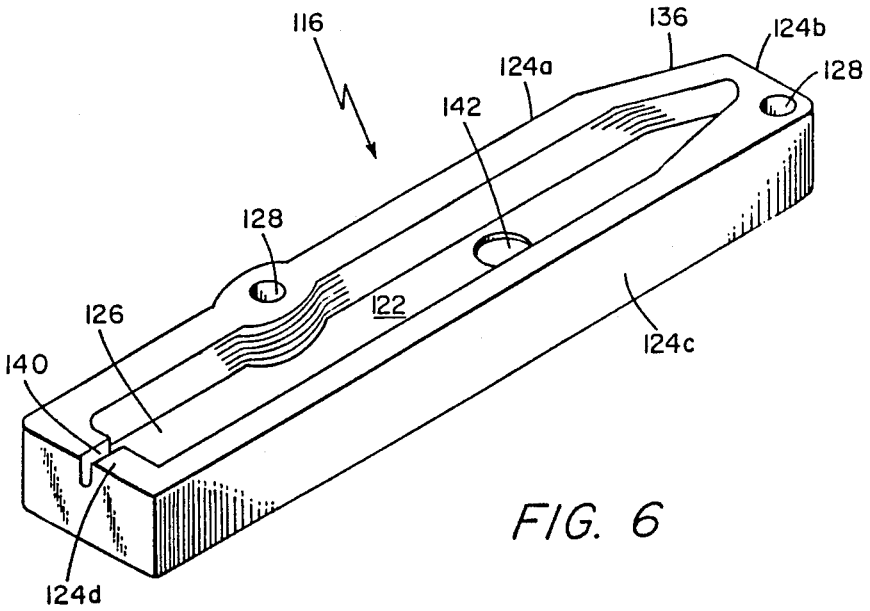
FIG. 6 is a perspective view of the cover.

Cover 116 or capsule seats up against outward wall 114 and forms a thermally insulated pocket 122 around thermostat bulb 104. More specifically, with reference to FIG. 6, cover 116 is here fabricated of an expanded synthetic resinous material such as Styrofoam and has a casket-like shape including four walls 124*a–d*, and a bottom 126 thereby defining pocket 122 or hollow therein. Walls 124*a–c* are here contoured so as to provide bores 128 for inserting suitable fasteners 130 for attaching to outward wall 114 as shown in FIG. 5. Preferably, fasteners 130 have ends 132 (FIG. 4) that snap through corresponding mounting holes 134 in outward wall 114. Also, walls 124*a* and *b* are here truncated at corner 136 so as to conform with the front edge 138 of outward wall 114.

Cover 116 also has a notch 140 to a provide a passageway for capillary tube 102 that extends from thermostat bulb 104 to thermostat control 83. Further, in accordance with the invention, cover 116 has an aperture 142, and there are holes 144 in the outward wall 114 adjacent to thermostat bulb 104 within pocket 122. Thus, when evaporator blower wheel 36 is activated thereby creating a negative pressure within air intake chamber 46, a gentle flow of ambient room air is drawn up channel 146 (FIG. 3) through holes 144 into pocket 122, and then through aperture 142 into air intake chamber 46. Channel 146 is formed between the outside surface 148 of outward wall 114 and the outer casing 18. Panel 150 isolates air intake chamber 46 and channel 146 at the front thereby providing a relatively constant flow of ambient room air through pocket 122. There are three holes 144 that are spaced along the length of bulb 104 so as to increase the temperature uniformity along the length of bulb 104.

In operation, the insulated pocket 122 housing thermostat bulb 104 is approximately maintained at the ambient temperature of the room. Accordingly, via capillary tube 102, the thermostat bulb 104 provides the thermostat control 83 with an accurate indication of the ambient room temperature for cycling air conditioner 10 on and off. More specifically, when the evaporator blower wheel 36 is activated, the gentle flow of ambient room air which is drawn up channel 146 and through pocket 122 maintains the thermostat bulb 104 at approximately room temperature. Then, when the temperature of thermostat bulb 104 decreases to a predetermined temperature as controlled by the setting of thermostat control knob 83*a*, thermostat control 83 switches and deactivates evaporator blower wheel 36, condenser fan 56, and compressor 54. When the temperature of thermostat bulb 104 then rises to a predetermined temperature, the thermostat control 83 reactivates the evaporator blower wheel 36, condensor fan 56, and compressor 54 for another cooling cycle.

It has been found that even if door 32 is open so as to introduce fresh air through vent 34, the thermostat bulb 104 is not falsely biased by the relatively hot fresh air because the thermostat bulb 104 is shielded or encapsulated in thermally insulating cover 116. Even when the evaporator blower wheel 36 is deactivated so that air is not being drawn into air intake chamber 46 through aperture 142, only a relatively small amount of fresh air heat passes through aperture 142 into pocket 122. Accordingly, in accordance with the invention, the temperature of thermostat bulb 104 accurately reflects the ambient room tempearture in all modes of operation of air conditioner 10. Therefore, in accordance with the invention, it has been found that the room temperature is more closely controlled. Further, it has been found that by using cover 116 to shield thermostat bulb 104, short cycles are avoided because fresh air is prevented from significantly effecting or falsely biasing the thermostat bulb 104. More specifically, if thermostat bulb 104 were biased by hot fresh air from outside rather than ambient room air, the temperature on the bulb 104 could rise too fast thus shortening the off cycle. Then, as soon as the evaporator blower wheel 36 was turned on by thermostat control 83, thermostat bulb 104 would be rapidly cooled by the ambient room air drawn across it. The result would be that compressor 54 would be turned off an on at a relatively fast rate thereby increasing its failure rate. By shielding the thermostat bulb 104 in a thermally insulated pocket 122, the temperature of the thermostat bulb 104 rises in a normal operating manner as a function of the room temperature. Accordingly, short cycles are avoided, and the failure rate of compressor 54 is improved.

This concludes the description of the preferred embodiment. A reading by those skilled in the art will bring to mind many alterations and modifications without departing from the spirit and scope of the invention. Accordingly, it is intended that the scope of the invention be limited only by the appended claims.

What is claimed is:

1. An air conditioner comprising:

a partition separating outside fresh air from room air;

an evaporator and an air intake chamber positioned on the room air side of said partition;

a blower for recirculating room air through said evaporator, said blower having an inlet communicating with said air intake chamber for drawing air from the room into said blower via said air intake chamber, said blower further having an outlet directed to said evaporator;

means for mixing outside fresh air into said recirculating room air, said mixing means comprising a vent in said partition and a door for closing said vent, said vent communicating with said blower wherein, when said door is open and said blower is activated, said outside fresh air is drawn through said vent into said blower;

a temperature sensor positioned in said air intake chamber for sensing the temperature of room air;

means responsive to said temperature sensor for cycling said air conditioner on and off; and means for inhibiting said temperature sensor from being biased by outside fresh air when said door is open, said inhibiting means comprising a thermally insulated pocket housing said temperature sensor, said pocket comprising means for enabling said recirculating room air to be drawn through said pocket over said temperature sensor before being drawn into said blower.

2. The air conditioner recited in claim 1 wherein said enabling means comprising a plurality of holes in said pocket whereby room air is drawn through said pocket to said inlet of said blower when said blower is activated.

3. An air conditioner comprising:

a partition separating outside fresh air from room air;

an evaporator positioned on the room air side of said partition;

a blower for recirculating room air through said evaporator, said blower having an inlet drawing air and an outlet directed to said evaporator;

means for mixing outside fresh air into said recirculating room air, said mixing means comprising a vent in said partition and a door for closing said vent, said vent communicating with said blower wherein, when said door is open and said blower is activated, said outside fresh air is drawn through said vent into said blower;

a temperature sensor for sensing the temperature of room air;

means responsive to said temperature sensor for cycling said air conditioner on and off;

a thermally insulated pocket for housing said temperature sensor, said pocket comprising means for providing a flow of recirculating room air over said temperature sensor; and an air intake chamber communicating with said inlet of said blower, said air intake chamber having a side wall and said pocket comprising an insulated casket seated against said side wall encasing said temperature sensor, said providing means comprising at least one hole in said casket and at least one hole in said side wall wherein, when said blower is activated, room air is drawn through said hole in said wall into said pocket and then through said hole in said casket into said air intake chamber.

4. An air conditioner comprising a front compartment communicating with a room to be cooled and a back compartment communicating with outside fresh air, said front and back compartments being separated by a partition, said front compartment having an evaporator, a blower having an outlet directed to said evaporator, and an inlet communicating with an air intake chamber having inward and outward side walls, said partition having a fresh air vent and a door wherein, in one mode of operation when said door is closed, only room air recirculates through said air intake chamber, said blower, and said evaporator back to said room, and wherein, in a second mode of operation when said door is open, outside fresh air from said back compartment flows through said vent and mixes with said recirculating room air before being directed through said evaporator, a temperature sensor mounted adjacent to said outward side wall of said air intake chamber for sensing the temperature of room air, a thermostat control responsive to said temperature sensor, means for thermally insulating said temperature sensor from said fresh air flowing through said vent, said insulating means comprising an insulation cover forming a pocket around said temperature sensor, said cover having at least one hole for permitting a flow of room air to be drawn through said pocket to said blower.

5. The air conditioner recited in claim 4 further comprising at least one hole in said outward side wall communicating with said pocket.

6. The air conditioner recited in claim 5 further comprising an air channel outside said outward side wall, said flow of room air flowing through said air channel into said pocket through said hole in said outward side wall, said room air further flowing into said air intake chamber through said hole in said cover.

7. The air conditioner recited in claim 6 wherein said temperature sensor comprises a thermostat bulb coupled to said thermostat control via a capillary tube.

* * * * *